US011114056B2

(12) United States Patent
Nam et al.

(10) Patent No.: US 11,114,056 B2
(45) Date of Patent: Sep. 7, 2021

(54) POWER VOLTAGE GENERATING CIRCUIT COMPENSATING RIPPLE OF A DATA POWER VOLTAGE AND DISPLAY APPARATUS INCLUDING THE SAME

(71) Applicant: Samsung Display Co., Ltd., Yongin-Si (KR)

(72) Inventors: Yanguk Nam, Hwaseong-si (KR); Dae-Sik Lee, Hwaseong-si (KR); Taegon Im, Gwangmyeong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/388,231

(22) Filed: Apr. 18, 2019

(65) Prior Publication Data

US 2020/0020297 A1 Jan. 16, 2020

(30) Foreign Application Priority Data

Jul. 16, 2018 (KR) ..... 10-2018-0082546

(51) Int. Cl.
*G09G 5/00* (2006.01)

(52) U.S. Cl.
CPC ..... *G09G 5/003* (2013.01); *G09G 2310/08* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 6,995,735 | B2 * | 2/2006 | Mizobata | G09G 3/2022 345/60 |
| 7,429,971 | B2 * | 9/2008 | Park | G09G 3/3648 345/50 |
| 9,041,746 | B2 * | 5/2015 | Byun | G09G 3/3233 345/690 |
| 9,754,548 | B2 * | 9/2017 | Park | G09G 3/3688 |
| 10,089,952 | B2 * | 10/2018 | Nam | G09G 3/3688 |
| 10,295,848 | B2 * | 5/2019 | Kim | G02F 1/0123 |
| 10,460,668 | B2 * | 10/2019 | Li | G09G 3/3233 |
| 10,490,154 | B2 * | 11/2019 | Fujikawa | G09G 3/3614 |
| 10,504,405 | B2 * | 12/2019 | Bae | G09G 3/2074 |
| 2004/0207618 | A1 * | 10/2004 | Williams | G06F 3/1446 345/212 |

(Continued)

FOREIGN PATENT DOCUMENTS

| | | | |
|---|---|---|---|
| KR | 100444491 | B1 | 10/2003 |
| KR | 1020140120108 | A | 10/2014 |

(Continued)

*Primary Examiner* — Chad M Dicke
(74) *Attorney, Agent, or Firm* — Cantor Colburn LLP

(57) ABSTRACT

A display apparatus includes a display panel, a data driver, a power voltage generator, a driving controller and a timing compensator. The display panel displays an image based on input image data. The data driver outputs a data voltage to the display panel. The power voltage generator outputs a data power voltage to the data driver. The driving controller controls a driving timing of the data driver. The timing compensator changes an output timing of the data voltage of the data driver when a feedback data power voltage is less than a reference data power voltage at a start point of an active period.

18 Claims, 12 Drawing Sheets

(56) References Cited

U.S. PATENT DOCUMENTS

| | | | | |
|---|---|---|---|---|
| 2005/0024033 | A1* | 2/2005 | Nakata | H02M 1/36 323/282 |
| 2005/0030272 | A1* | 2/2005 | Hosaka | G09G 3/3614 345/92 |
| 2010/0091006 | A1* | 4/2010 | Yoo | G09G 3/3233 345/213 |
| 2010/0134401 | A1* | 6/2010 | Shin | G09G 3/3611 345/99 |
| 2011/0169813 | A1* | 7/2011 | Jin | G09G 3/20 345/212 |
| 2012/0038614 | A1* | 2/2012 | Mizumaki | G09G 3/3614 345/211 |
| 2012/0262390 | A1* | 10/2012 | Kida | G06F 3/041 345/173 |
| 2015/0109347 | A1* | 4/2015 | Wen | G09G 3/3607 345/690 |
| 2016/0092010 | A1* | 3/2016 | Agarwal | G06F 3/0416 345/173 |
| 2016/0203746 | A1* | 7/2016 | Kim | G09G 3/3696 345/211 |
| 2016/0267871 | A1* | 9/2016 | Kim | G09G 3/3688 |
| 2018/0109194 | A1* | 4/2018 | Peng | H02M 1/36 |
| 2018/0190192 | A1* | 7/2018 | Kwon | G09G 3/3233 |
| 2018/0308443 | A1* | 10/2018 | Yamagishi | G09G 3/20 |
| 2019/0385563 | A1* | 12/2019 | Hirokane | G09G 3/20 |
| 2020/0020297 | A1* | 1/2020 | Nam | G09G 5/003 |

FOREIGN PATENT DOCUMENTS

| | | | |
|---|---|---|---|
| KR | 1020160017871 | A | 2/2016 |
| KR | 1020160078766 | A | 7/2016 |
| KR | 1020160147126 | A | 12/2016 |

* cited by examiner

POWER VOLTAGE GENERATING CIRCUIT COMPENSATING RIPPLE OF A DATA POWER VOLTAGE AND DISPLAY APPARATUS INCLUDING THE SAME

This application claims priority to Korean Patent Application No. 10-2018-0082546, filed on Jul. 16, 2018, and all the benefits accruing therefrom under 35 U.S.C. § 119, the content of which in its entirety is herein incorporated by reference.

BACKGROUND

1. Field

Exemplary embodiments of the invention relate to a power voltage generating circuit and a display apparatus including the power voltage generating circuit. More particularly, exemplary embodiments of the invention relate to a power voltage generating circuit compensating a ripple of a data power voltage and a display apparatus including the power voltage generating circuit.

2. Description of the Related Art

A display apparatus generally includes a display panel, a display panel driver driving the display panel and a power voltage generator providing a power voltage to the display panel driver.

The display panel generally includes a plurality of gate lines, a plurality of data lines and a plurality of pixels. The display panel driver generally includes a gate driver which outputs gate signals to the plurality of gate lines and a data driver which outputs data voltages to the plurality of data lines.

SUMMARY

A ripple may be generated at a data power voltage provided to the data driver according to a load of a data driver. Due to the ripple of the data power voltage, a display quality of the display panel may be deteriorated.

Exemplary embodiments of the invention provide a power voltage generating circuit compensating a ripple of a data power voltage to enhance a display quality.

Exemplary embodiments of the invention also provide a display apparatus including the above-mentioned power voltage generating circuit.

In an exemplary embodiment of a display apparatus according to the invention, the display apparatus includes a display panel, a data driver, a power voltage generator, a driving controller and a timing compensator. The display panel displays an image based on input image data. The data driver outputs a data voltage to the display panel. The power voltage generator outputs a data power voltage to the data driver. The driving controller controls a driving timing of the data driver. The timing compensator changes an output timing of the data voltage of the data driver when a feedback data power voltage is less than a reference data power voltage at a start point of an active period.

In an exemplary embodiment, the reference data power voltage may be the data power voltage which is fed back after a first time from a rising edge of a vertical start signal.

In an exemplary embodiment, the timing compensator may adjust the output timing of the data voltage such that a start point of outputting the data voltage is in a vertical blank period which is prior to the active period.

In an exemplary embodiment, the timing compensator may include an analog to digital converter which converts the feedback data power voltage and the reference data power voltage and a data power voltage comparator which compares a converted feedback data power voltage and the converted reference data power voltage.

In an exemplary embodiment, the analog to digital converter and the data power voltage comparator may be disposed in the power voltage generator.

In an exemplary embodiment, the analog to digital converter may be disposed in the power voltage generator. The data power voltage comparator may be disposed in the driving controller.

In an exemplary embodiment, the power voltage generator may include a capacitor comprising a first electrode connected to an input node and a second electrode connected to a ground, an inductor comprising a first end portion connected to the input node and a second end portion connected to a first node, a diode comprising an anode electrode connected to the first node and a cathode electrode connected to an output node, a switch comprising a control electrode connected to a switch controller, an input electrode connected to the first node and an output node connected to the ground, a resistor comprising a first end portion connected to the output node and a second end portion connected to a feedback node, an error amplifier comprising a first input electrode connected to the feedback node, a second input electrode to which a reference voltage is applied and an output electrode, a comparator comprising a first input electrode connected to the output electrode of the error amplifier, a second input electrode to which a comparison voltage and an output electrode connected to the switch controller and the switch controller which is connected to the comparator and controls the switch. The timing compensator may be connected to the feedback node.

In an exemplary embodiment, the display apparatus may further include a second timing compensator which applies a load to an output node of the data power voltage in a vertical blank period prior to the active period.

In an exemplary embodiment, the second timing compensator may include a compensating resistor and a compensating switch connected in series.

In an exemplary embodiment, the second timing compensator may include a first compensating part comprising a first compensating resistor and a first compensating switch connected in series and a second compensating part comprising a second compensating resistor and a second compensating switch connected in series. The second compensating part may be connected to the first compensating part in parallel.

In an exemplary embodiment, a turn-on period of the first compensating switch may be different from a turn-on period of the second compensating switch.

In an exemplary embodiment, the power voltage generator may include a capacitor comprising a first electrode connected to an input node and a second electrode connected to a ground, an inductor comprising a first end portion connected to the input node and a second end portion connected to a first node, a diode comprising an anode electrode connected to the first node and a cathode electrode connected to an output node, a switch comprising a control electrode connected to a switch controller, an input electrode connected to the first node and an output node connected to the ground, a resistor comprising a first end portion connected to the output node and a second end portion connected to a feedback node, an error amplifier comprising a first input electrode connected to the feedback node, a second input electrode to which a reference voltage is applied and an output electrode, a comparator comprising a first input electrode connected to the output electrode of the error amplifier, a second input electrode to which a comparison voltage and an output electrode connected to the switch controller and the switch controller which is connected to the comparator and controls the switch. The second timing compensator may be connected to the feedback node.

In an exemplary embodiment, the display apparatus may further include a second timing compensator which adjusts the output timing of the data voltage of the data driver according to the input image data.

In an exemplary embodiment, the second timing compensator may be disposed in the driving controller.

In an exemplary embodiment of a power voltage generating circuit according to the invention, the power voltage generating circuit includes a capacitor comprising a first electrode connected to an input node to which an input voltage is applied and a second electrode connected to a ground, an inductor comprising a first end portion connected to the input node and a second end portion connected to a first node, a diode comprising an anode electrode connected to the first node and a cathode electrode connected to an output node which outputs an output voltage, a switch comprising a control electrode connected to a switch controller, an input electrode connected to the first node and an output node connected to the ground, a resistor comprising a first end portion connected to the output node and a second end portion connected to a feedback node, an error amplifier comprising a first input electrode connected to the feedback node, a second input electrode to which a reference voltage is applied and an output electrode, a comparator comprising a first input electrode connected to the output electrode of the error amplifier, a second input electrode to which a comparison voltage and an output electrode connected to the switch controller, the switch controller which is connected to the comparator and controls the switch and a timing compensator connected to the feedback node to receive a feedback output voltage, the timing compensator output a timing compensating signal according to a level of the feedback output voltage.

In an exemplary embodiment, the timing compensator may include an analog to digital converter which converts the feedback output voltage and a reference data power voltage and a data power voltage comparator which compares the converted feedback output voltage and a converted reference data power voltage.

In an exemplary embodiment, the timing compensator may include a compensating resistor and a compensating switch connected in series.

In an exemplary embodiment, the timing compensator may include a first compensating part comprising a first compensating resistor and a first compensating switch connected in series and a second compensating part comprising a second compensating resistor and a second compensating switch connected in series. The second compensating part may be connected to the first compensating part in parallel.

In an exemplary embodiment, a turn-on period of the first compensating switch may be different from a turn-on period of the second compensating switch.

According to the power voltage generating circuit and the display apparatus including the power voltage generating circuit, the data power voltage is fed back and a waveform of the data power voltage is controlled such that the data power voltage may not be dropped in the active period. Thus, the display quality of the display panel may be prevented from being deteriorated due to the drop of the data power voltage. Therefore, the display quality of the display panel may be enhanced. In addition, a display panel driving signal is maintained in a uniform level during the vertical blank period so that the power consumption of the display apparatus may be reduced.

BRIEF DESCRIPTION OF THE DRAWINGS

The above and other features and advantages of the invention will become more apparent by describing in detailed exemplary embodiments thereof with reference to the accompanying drawings, in which.

DETAILED DESCRIPTION

Figure 1:
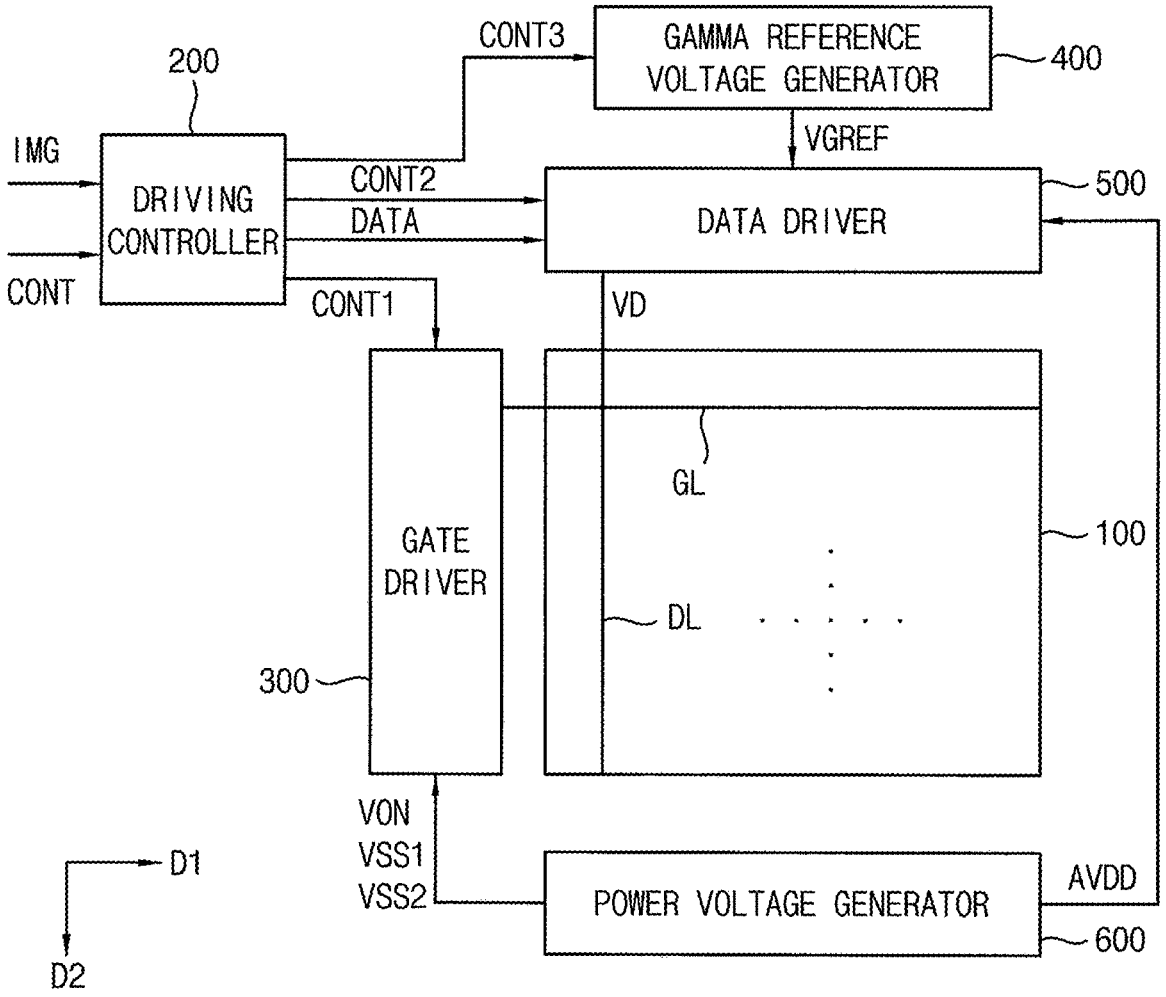
FIG. 1 is a block diagram illustrating an exemplary embodiment of a display apparatus according to the invention.

Hereinafter, the invention will be explained in detail with reference to the accompanying drawings.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

FIG. 1 is a block diagram illustrating a display apparatus according to an exemplary embodiment of the invention.

Referring to FIG. 1, the display apparatus includes a display panel 100 and a display panel driver. The display panel driver includes a driving controller 200, a gate driver 300, a gamma reference voltage generator 400, a data driver 500 and a power voltage generator 600.

The display panel 100 includes a display region and a peripheral region adjacent to the display region.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus (not shown). In an exemplary embodiment, the input image data IMG may include red image data, green image data and blue image data, for example. In an exemplary embodiment, the input image data IMG may include white image data, for example. In an exemplary embodiment, the input image data IMG may include magenta image data, yellow image data and cyan image data, for example. In an exemplary embodiment, the input control signal CONT may include a master clock signal and a data enable signal, for example. In an exemplary embodiment, the input control signal CONT may further include a vertical synchronizing signal and a horizontal synchronizing signal, for example.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. In an exemplary embodiment, the first control signal CONT1 may include a vertical start signal and a gate clock signal, for example.

The driving controller 200 generates the second control signal CONT2 for controlling an operation of the data driver 500 based on the input control signal CONT, and outputs the second control signal CONT2 to the data driver 500. In an exemplary embodiment, the second control signal CONT2 may include a horizontal start signal and a load signal, for example.

The driving controller 200 generates the data signal DATA based on the input image data IMG The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 may sequentially output the gate signals to the gate lines GL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In the illustrated exemplary embodiment, the gamma reference voltage generator 400 is physically separated from the driving controller 200 and the data driver 500. However, the invention is not limited thereto. In another exemplary embodiment, the gamma reference voltage generator 400 may be disposed in the driving controller 200, or in the data driver 500, for example.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The power voltage generator 600 generates gate power voltages VON, VSS1 and VSS2 to operate the gate driver 300 and the power voltage generator 600 outputs the gate power voltages VON, VSS1 and VSS2 to the gate driver 300. The gate power voltage may include a gate on voltage VON representing a high level of the gate signal, a first gate off voltage VSS1 and a second gate off voltage VSS2 representing low levels of the gate signal.

The power voltage generator 600 generates a data power voltage AVDD to operate the data driver 500 and the power voltage generator 600 outputs the data power voltage AVDD to the data driver 500. The data driver power voltage AVDD may be an analog power voltage provided to an amplifier in the data driver 500.

Figure 2:
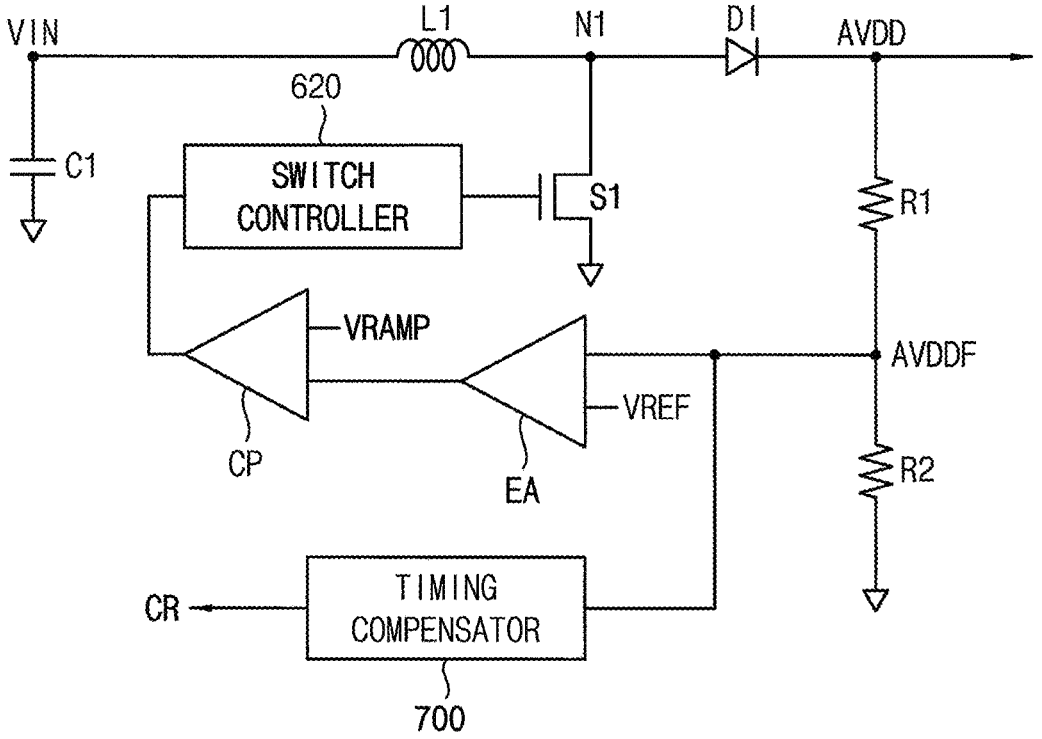
FIG. 2 is a block diagram illustrating a power voltage generator of FIG. 1 and a timing compensator.
Figure 3:
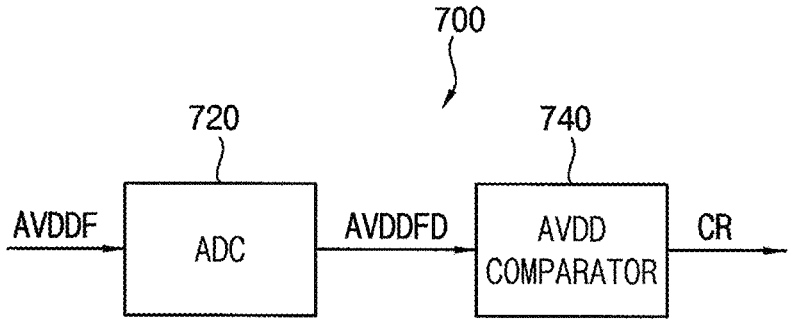
FIG. 3 is a block diagram illustrating the timing compensator of FIG. 2.

FIG. 2 is a block diagram illustrating the power voltage generator 600 of FIG. 1 and a timing compensator 700. FIG. 3 is a block diagram illustrating the timing compensator 700 of FIG. 2.

Referring to FIGS. 1 to 3, the power voltage generator 600 may include a DC to DC converter generating the data power voltage AVDD.

The power voltage generator 600 includes a capacitor C1, an inductor L1, a diode D1, a switch S1, a resistor R1, an error amplifier EA, a comparator CP and a switch controller 620.

The capacitor C1 includes a first electrode connected to an input node to which an input voltage VIN is applied and a second electrode connected to a ground.

The inductor L1 include a first end portion connected to the input node and a second end portion connected to a first node N1.

The diode D1 includes an anode electrode connected to the first node N1 and a cathode electrode connected to an output node outputting the data power voltage AVDD. The data power voltage AVDD is outputted to the data driver 500.

The switch S1 includes a control electrode connected to the switch controller 620, an input electrode connected to the first node N1 and an output node connected to the ground.

The resistor R1 includes a first end portion connected to the output node and a second end portion connected to a feedback node. The data power voltage AVDD is fed back through the feedback node. The power voltage generator 600 may further include a feedback resistor R2. The feedback resistor R2 includes a first end portion connected to the resistor R1 and a second end portion connected to the ground. The data power voltage AVDD is divided by the resistor R1 and the feedback resistor R2 so that a feedback data power voltage AVDDF is applied to the feedback node.

The error amplifier EA includes a first input electrode connected to the feedback node and a second input electrode to which a reference voltage VREF is applied and an output electrode. A difference between the feedback data power voltage AVDDF and the reference voltage VREF is amplified by the error amplifier EA and the amplified difference is outputted to the comparator CP.

The comparator CP includes a first input electrode connected to the output electrode of the error amplifier EA, a second input electrode to which a comparison voltage VRAMP is applied and an output electrode connected to the switch controller 620. The comparison voltage VRAMP may be a sawtooth wave signal. An output voltage of the comparator CP is provided to the switch controller 620.

The switch controller 620 is connected to the comparator CP. The switch controller 620 controls the switch S1. In an exemplary embodiment, the switch controller 620 may be a pulse width modulation controller outputting a pulse width modulation signal, for example. Turn-on time and turn-off time of the switch S1 are adjusted according to a switch control signal outputted by the switch controller 620. A level of the data power voltage AVDD may be adjusted according to the turn-on time and the turn-off time of the switch S1.

The display apparatus further includes the timing compensator 700 controlling an output timing of the data voltage VD.

When the feedback data power voltage AVDDF is less than a reference data power voltage at a start point of an active period, the timing compensator 700 adjusts the output timing of the data voltage VD of the data driver 500.

The timing compensator 700 may include an analog to digital converter 720 converting the feedback data power voltage AVDDF and the reference data power voltage and a data power voltage comparator 740 comparing the converted feedback data power voltage AVDDFD and the converted reference data power voltage.

In an exemplary embodiment, the analog to digital converter 720 and the data power voltage comparator 740 may be disposed in the power voltage generator 600, for example. In this case, the data power voltage comparator 740 may output a comparison result CR to the driving controller 200.

In an alternative exemplary embodiment, the analog to digital converter 720 may be disposed in the power voltage generator 600 and the data power voltage comparator 740 may be disposed in the driving controller 200. In this case, the analog to digital converter 720 may output the converted feedback data power voltage AVDDFD and the converted reference data power voltage to the driving controller 200.

Figure 4A:
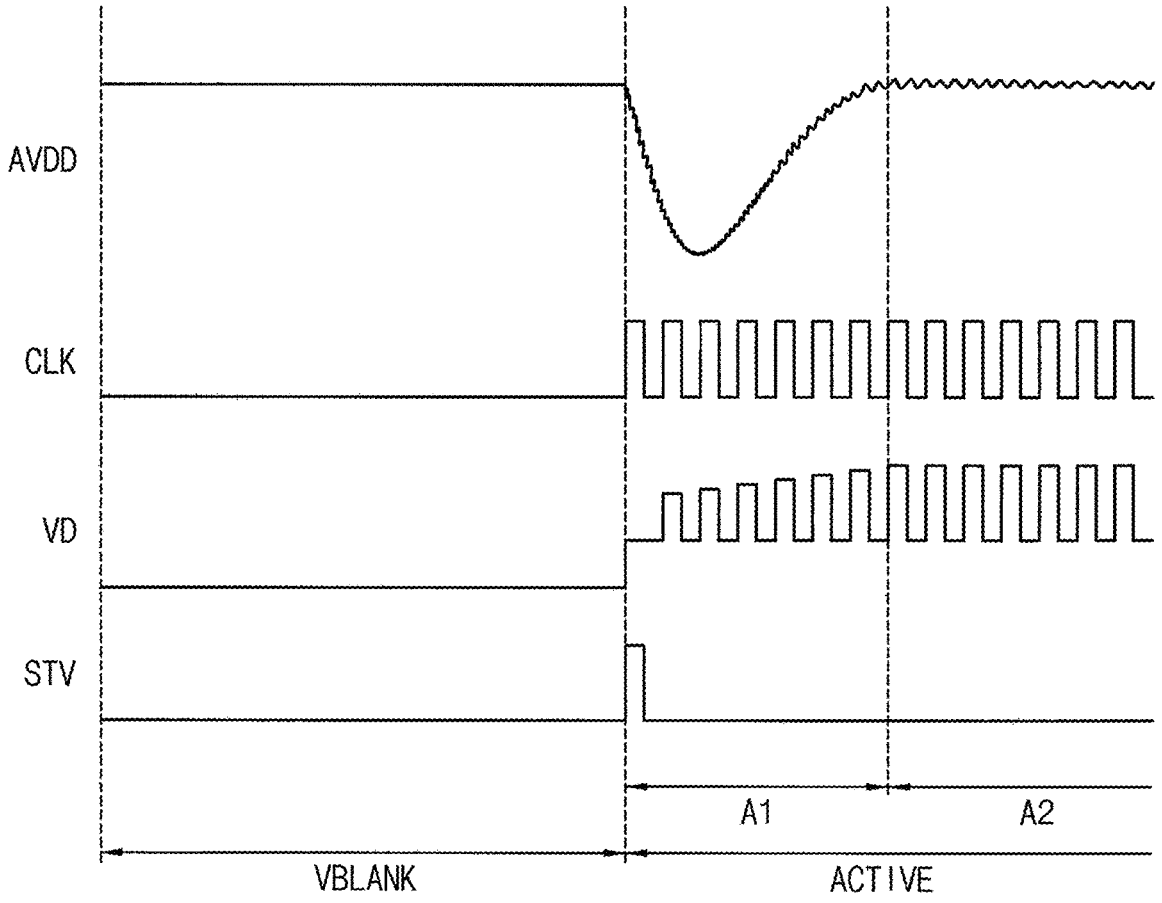
FIG. 4A is a timing diagram illustrating display panel driving signals when a data power voltage is not compensated by the timing compensator of FIG. 2.
Figure 4B:
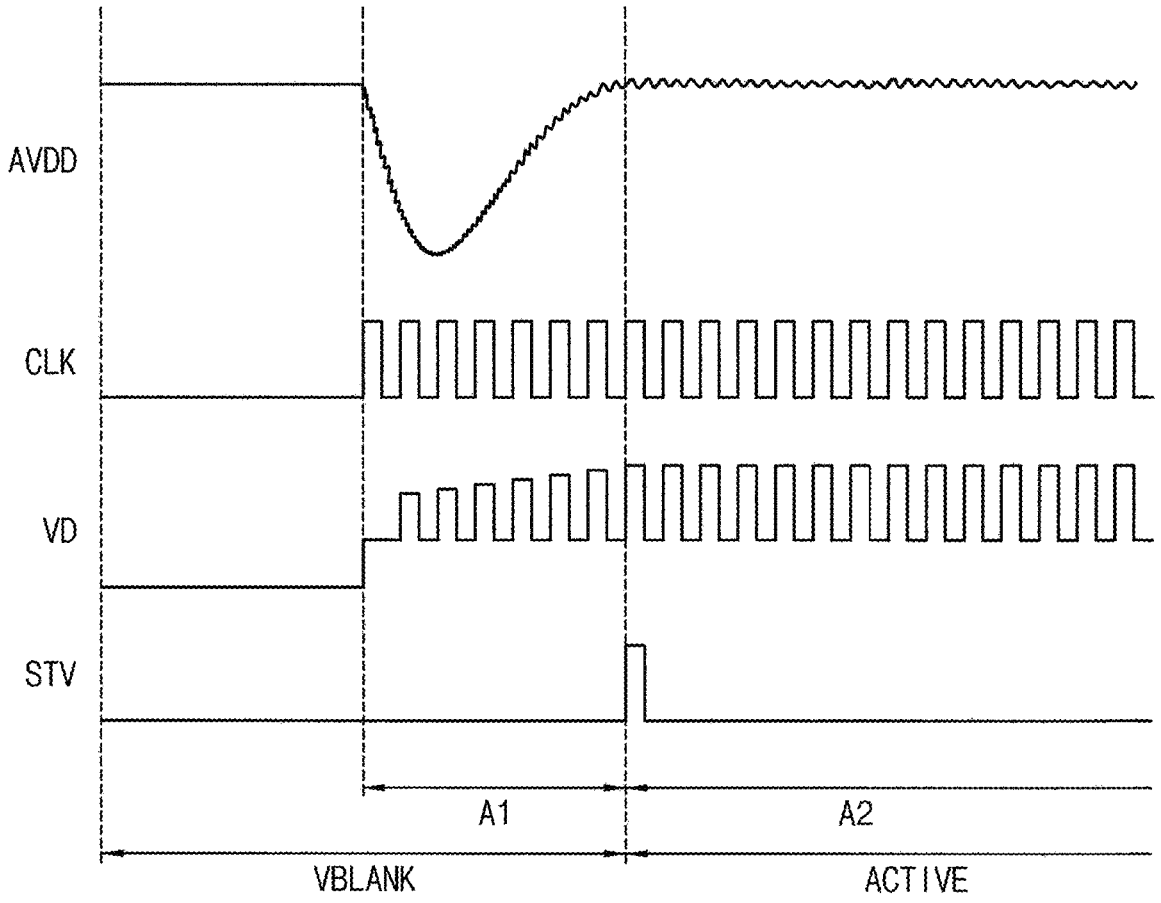
FIG. 4B is a timing diagram illustrating the display panel driving signals when the data power voltage is compensated by the timing compensator of FIG. 2.

FIG. 4A is a timing diagram illustrating display panel driving signals when the data power voltage AVDD is not compensated by the timing compensator 700 of FIG. 2. FIG. 4B is a timing diagram illustrating the display panel driving signals when the data power voltage AVDD is compensated by the timing compensator 700 of FIG. 2.

Referring to FIG. 4A, the data power voltage AVDD may be maintained in a uniform level during a vertical blank period VBLANK. When the data driver 500 starts to output the data voltage VD to the display panel 100 in the active period ACTIVE, the data power voltage AVDD may be dramatically decreased due to a sudden increase of load of the data driver 500 (period A1).

When an enough time passes from the start of the driving of the data driver 500, the data power voltage AVDD is returned to a stable level (period A2).

In a period where the level of the data power voltage AVDD is decreased, the level of the data voltage VD applied to the display panel 100 may be decreased in response to a target level so that a luminance of an image displayed on an upper portion of the display panel 100 corresponding to the start point of the active period ACTIVE may be decreased.

Referring to FIG. 4B, the timing compensator 700 may adjust the output timing of the data voltage VD such that the start point of outputting the data voltage VD is in the vertical blank period VBLANK which is prior to the active period ACTIVE. The output timing of the data voltage VD may be synchronized with a data clock signal CLK of the data driver 500. Thus, when the output timing of the data voltage VD is changed, the timing of the data clock signal CLK may be changed.

In an exemplary embodiment, when the feedback data power voltage AVDDF is less than the reference data power voltage at the start point of the active period ACTIVE, the timing compensator 700 advances the output timing of the data voltage VD by a first compensating time, for example. Herein, the reference data power voltage may be a data power voltage which is fed back after a first time from a rising edge of a vertical start signal STV. The data power voltage which is fed back after the first time from the rising edge of the vertical start signal STV may have a stable level. The first time may be set equal to or greater than a time for the data power voltage AVDD to be stable (e.g., period A1 in FIG. 4A).

In FIG. 4A, the data power voltage AVDD may be dramatically decreased due to the sudden increase of the load of the data driver 500 at the start point of the active period ACTIVE. The timing compensator 700 compares the feedback data power voltage AVDDF to the reference data power voltage, which has the stable level after the enough time, at the start point of the active period ACTIVE. In FIG. 4A, the feedback data power voltage AVDDF is less than the reference data power voltage at the start point of the active period ACTIVE so that the timing compensator 700 advances the output timing of the data voltage VD by the first compensating time.

In a next frame, the output timing of the data voltage VD is advanced by the first compensating time and the timing compensator 700 compares the feedback data power voltage AVDDF to the reference data power voltage at the start point of the active period ACTIVE of the next frame.

If the feedback data power voltage AVDDF is less than the reference data power voltage at the start point of the active period ACTIVE of the next frame, the timing compensator 700 advances the output timing of the data voltage VD by the first compensating time again. When the feedback data power voltage AVDDF is equal to or greater (i.e., not less) than the reference data power voltage at the start point of the active period ACTIVE of the next frame, the timing compensator 700 maintains the output timing of the data voltage VD.

As explained above, until the feedback data power voltage AVDDF is equal to the reference data power voltage at the start point of the active period ACTIVE, the output timing of the data voltage VD is adjusted. As a result, the data power voltage AVDD is dropped in the vertical blank period VBLANK (period A1 in FIG. 4B) and the data voltage VD may have the target level from a first pulse in the start point of the active period ACTIVE (period A2 in FIG. 4B).

According to the illustrated exemplary embodiment, the timing compensator 700 adjusts the data output timing of the data driver 500 based on the feedback data power voltage AVDDF so that the waveform of the data power voltage AVDD may be controlled not to be dropped in the active period ACTIVE. Thus, the display quality of the display panel 100 may be prevented from deterioration due to the drop of the data power voltage AVDD. Therefore, the display quality of the display panel 100 may be enhanced. In addition, the display panel driving signal may be maintained in a uniform level during the vertical blank period VBLANK so that the power consumption of the display apparatus may be reduced.

Figure 5:
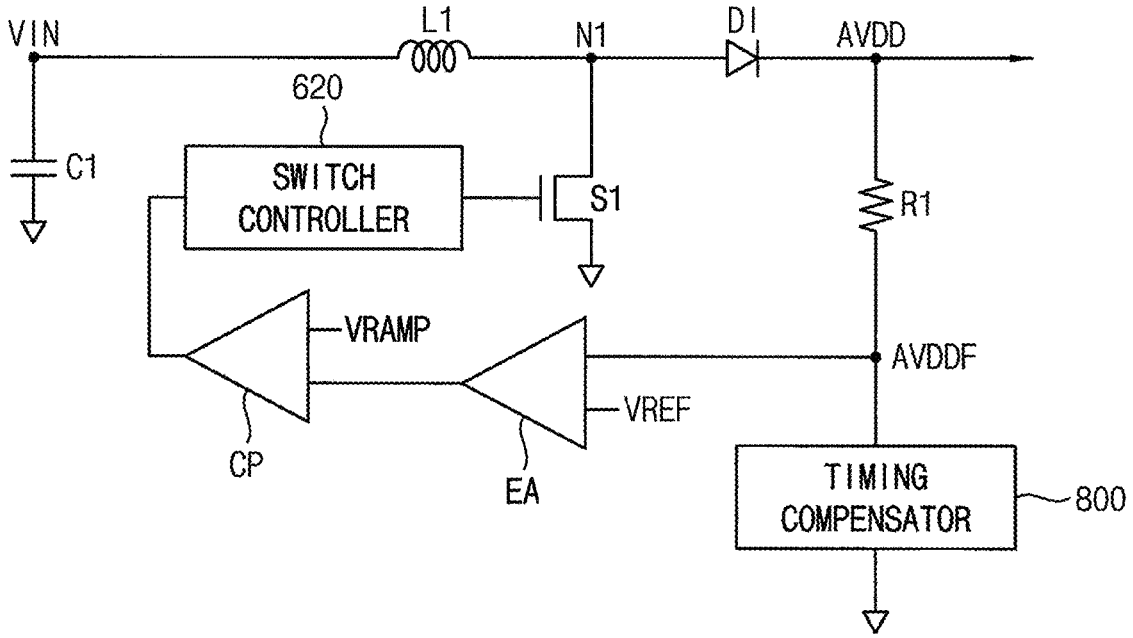
FIG. 5 is a block diagram illustrating an exemplary embodiment of a power voltage generator and a timing compensator according to the invention.
Figure 6:
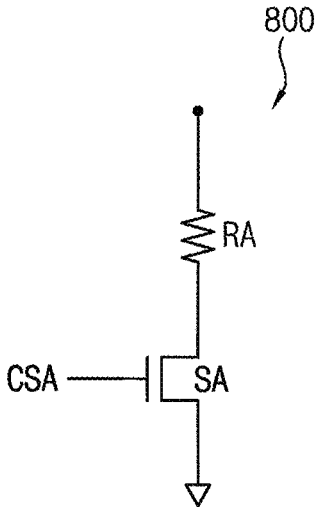
FIG. 6 is a circuit diagram illustrating the timing compensator of FIG. 5.

FIG. 5 is a block diagram illustrating a power voltage generator 600 and a timing compensator 800 according to an exemplary embodiment of the invention. FIG. 6 is a circuit diagram illustrating the timing compensator 800 of FIG. 5.

The power voltage generating circuit and the display apparatus according to the illustrated exemplary embodiment is substantially the same as the power voltage generating circuit and the display apparatus of the previous exemplary embodiment explained referring to FIGS. 1 to 4B except for the timing compensator. Thus, the same reference numerals will be used to refer to the same or like parts as those described in the previous exemplary embodiment of FIGS. 1 to 4B and any repetitive explanation concerning the above elements will be omitted.

Referring to FIGS. 1, 5 and 6, the display apparatus includes a display panel 100 and a display panel driver. The display panel driver includes a driving controller 200, a gate driver 300, a gamma reference voltage generator 400, a data driver 500 and a power voltage generator 600.

The display apparatus further includes the timing compensator 800 applying a load to an output node of the data power voltage AVDD in a vertical blank period VBLANK.

In an exemplary embodiment, the display apparatus may include the timing compensator 800 of the illustrated exemplary embodiment instead of the timing compensator 700 of the previous exemplary embodiment of FIG. 3, for example. In an alternative exemplary embodiment, the display apparatus may include both the timing compensator 700 of the previous exemplary embodiment and the timing compensator 800 of the illustrated exemplary embodiment.

The timing compensator 800 may include a compensating resistor RA and a compensating switch SA connected in series.

When the compensating switch SA is turned on, the load of the compensating resistor RA is applied to the output node of the data power voltage AVDD. The compensating switch SA is turned on in the vertical blank period VBLANK prior to the active period ACTIVE.

Figure 7A:
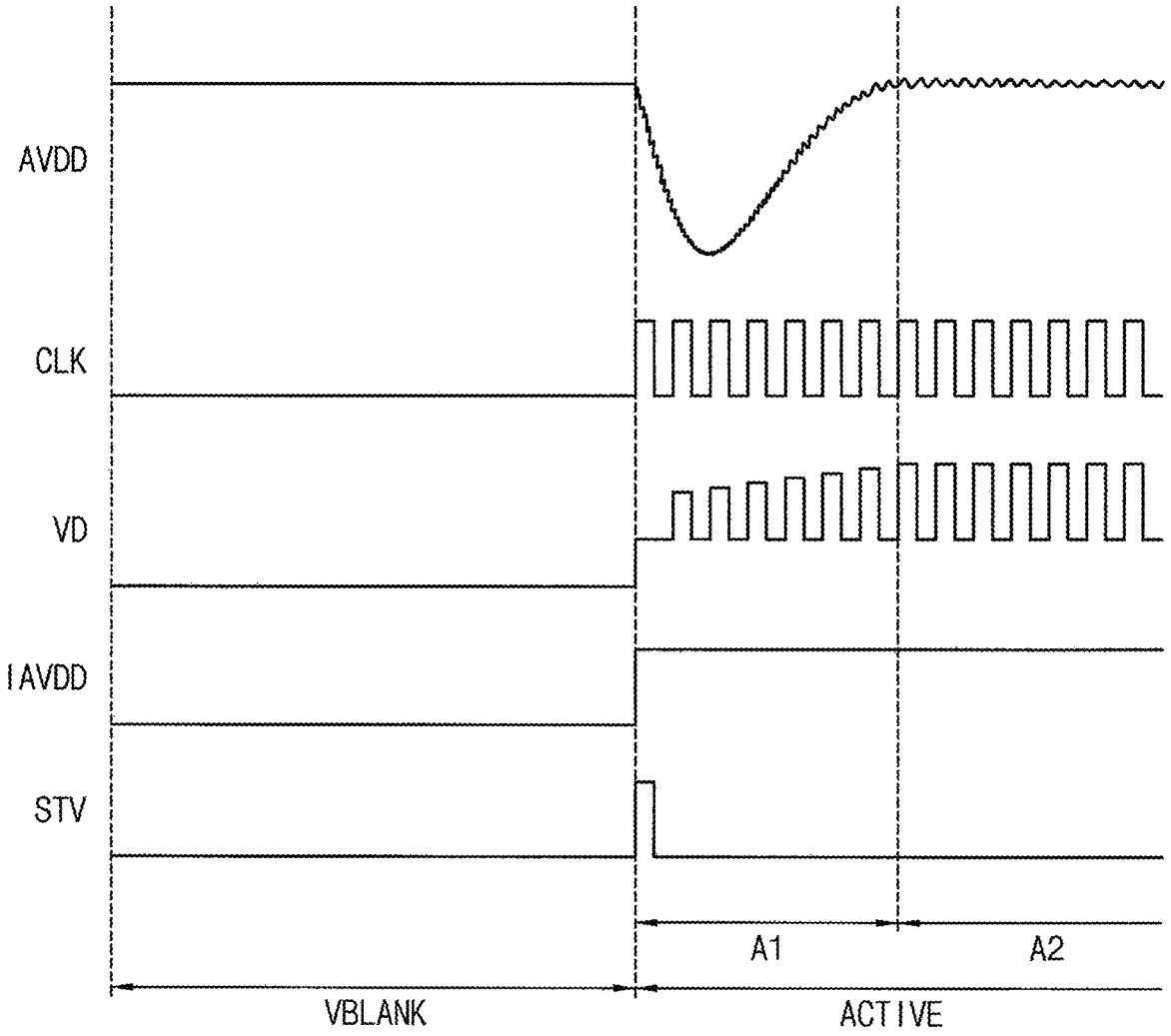
FIG. 7A is a timing diagram illustrating display panel driving signals when a data power voltage is not compensated by the timing compensator of FIG. 5.
Figure 7B:
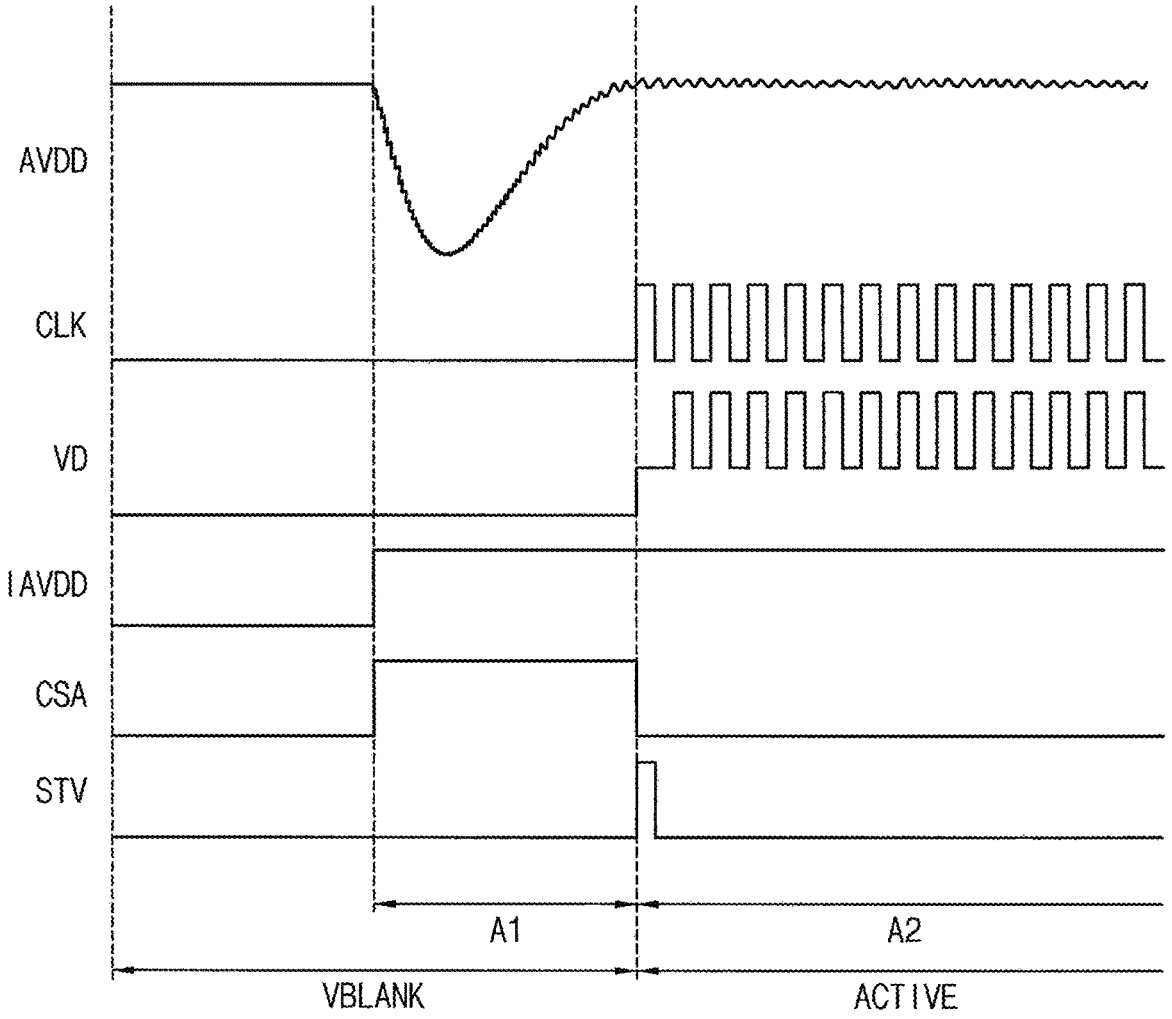
FIG. 7B is a timing diagram illustrating the display panel driving signals when the data power voltage is compensated by the timing compensator of FIG. 5.

FIG. 7A is a timing diagram illustrating display panel driving signals when a data power voltage AVDD is not compensated by the timing compensator 800 of FIG. 5. FIG. 7B is a timing diagram illustrating the display panel driving signals when the data power voltage AVDD is compensated by the timing compensator 800 of FIG. 5.

Referring to FIG. 7A, the data power voltage AVDD may be maintained in a uniform level during a vertical blank period VBLANK. When the data driver 500 starts to output the data voltage VD to the display panel 100 in the active period ACTIVE, the data power voltage AVDD may be dramatically decreased due to a sudden increase of load IAVDD of the data driver 500 (period A1).

When an enough time passes from the start of the driving of the data driver 500, the data power voltage AVDD is returned to a stable level (period A2).

In a period where the level of the data power voltage AVDD is decreased, the level of the data voltage VD applied to the display panel 100 may be decreased in response to a target level so that a luminance of an image displayed on an upper portion of the display panel 100 corresponding to the start point of the active period ACTIVE may be decreased.

Referring to FIG. 7B, the compensating switch SA is turned on in response to a compensating switch control signal CSA applied to the compensating switch SA before the vertical start signal STV is applied. When the compensating switch SA is turned on, the load IAVDD corresponding to resistance of the compensating resistor RA is applied to the output node of the data power voltage AVDD from the vertical blank period VBLANK.

As a result, the data power voltage AVDD is dropped in the vertical blank period VBLANK (period A1 in FIG. 7B) and the data voltage VD may have the target level from a first pulse in the start point of the active period ACTIVE (period A2 in FIG. 7B).

According to the illustrated exemplary embodiment, the timing compensator 800 applies the load to the output node of the data power voltage AVDD in the vertical blank period VBLANK so that the waveform of the data power voltage AVDD may be controlled not to be dropped in the active period ACTIVE. Thus, the display quality of the display panel 100 may be prevented from deterioration due to the drop of the data power voltage AVDD. Therefore, the display quality of the display panel 100 may be enhanced. In addition, the display panel driving signal may be maintained in a uniform level during the vertical blank period VBLANK so that the power consumption of the display apparatus may be reduced.

Figure 8:
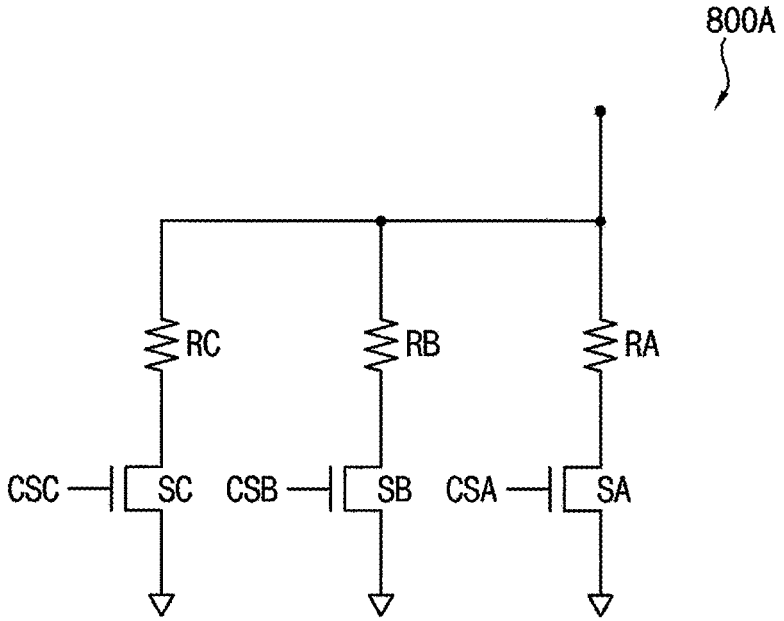
FIG. 8 is a circuit diagram illustrating an exemplary embodiment of a timing compensator according to the invention.
Figure 9:
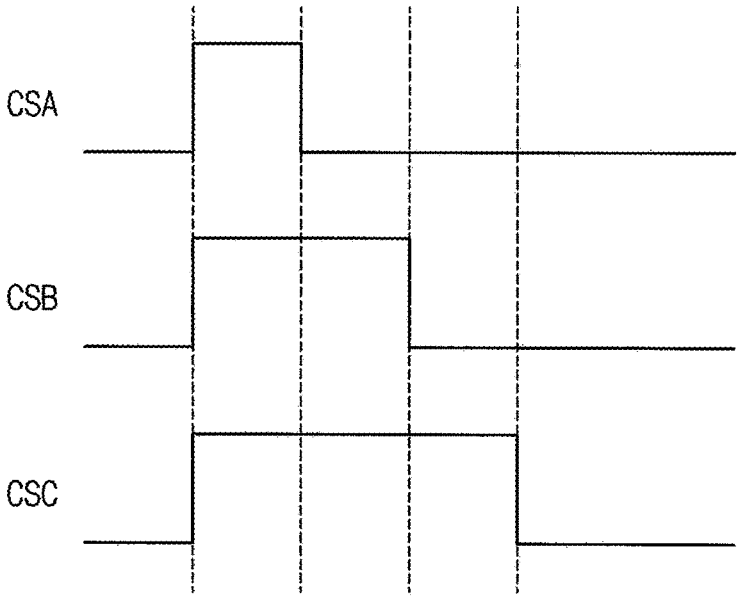
FIG. 9 is a timing diagram illustrating a control signal applied to the timing compensator of FIG. 8.

FIG. 8 is a circuit diagram illustrating a timing compensator 800A according to an exemplary embodiment of the invention. FIG. 9 is a timing diagram illustrating a control signal applied to the timing compensator 800A of FIG. 8.

The power voltage generating circuit and the display apparatus according to the illustrated exemplary embodiment is substantially the same as the power voltage generating circuit and the display apparatus of the previous exemplary embodiment explained referring to FIGS. 1 to 4B except for the timing compensator. Thus, the same reference numerals will be used to refer to the same or like parts as those described in the previous exemplary embodiment of FIGS. 1 to 4B and any repetitive explanation concerning the above elements will be omitted.

Referring to FIGS. 1, 8 and 9, the display apparatus includes a display panel 100 and a display panel driver. The display panel driver includes a driving controller 200, a gate driver 300, a gamma reference voltage generator 400, a data driver 500 and a power voltage generator 600.

The display apparatus further includes the timing compensator 800A applying a load to an output node of the data power voltage AVDD in a vertical blank period VBLANK.

In an exemplary embodiment, the display apparatus may include the timing compensator 800A of the illustrated exemplary embodiment instead of the timing compensator 700 of the previous exemplary embodiment of FIG. 3, for example. In an alternative exemplary embodiment, the display apparatus may include both the timing compensator 700 of the previous exemplary embodiment and the timing compensator 800A of the illustrated exemplary embodiment.

The timing compensator 800A may include a plurality of compensating parts. Each of the compensating parts may include a compensating resistor and a compensating switch connected in series.

Although the timing compensator 800A includes three compensating parts connected in parallel in the illustrated exemplary embodiment, the invention is not limited to the number of the compensating parts.

In an exemplary embodiment, the timing compensator 800A includes a first compensating part, a second compensating part and a third compensating part connected in parallel, for example. The first compensating part may include a first compensating resistor RA and a first compensating switch SA connected in series. The second compensating part may include a second compensating resistor RB and a second compensating switch SB connected in series. The third compensating part may include a third compensating resistor RC and a third compensating switch SC connected in series.

A turn-on period of the first compensating switch SA may be different from a turn-on period of the second compensating switch SB. The turn-on period of the second compensating switch SB may be different from a turn-on period of the third compensating switch SC. The turn-on period of the third compensating switch SC may be different from the turn-on period of the first compensating switch SA.

In an exemplary embodiment, a first compensating switch control signal CSA may be activated in a first duration, for example. In an exemplary embodiment, a second compensating switch control signal CSB may be activated in the first duration and a second duration, for example. In an exemplary embodiment, a third compensating switch control signal CSC may be activated in the first duration, the second duration and a third duration, for example.

In the first duration, the first to third compensating switch control signals CSA, CSB and CSC have activating levels so that the first to third compensating switches SA, SB and SC are turned on.

In the second duration, the second and third compensating switch control signals CSB and CSC have activating levels so that the second and third compensating switches SB and SC are turned on.

In the third duration, the third compensating switch control signal CSC has an activating level so that the third compensating switch SC is turned on.

Figure 10:
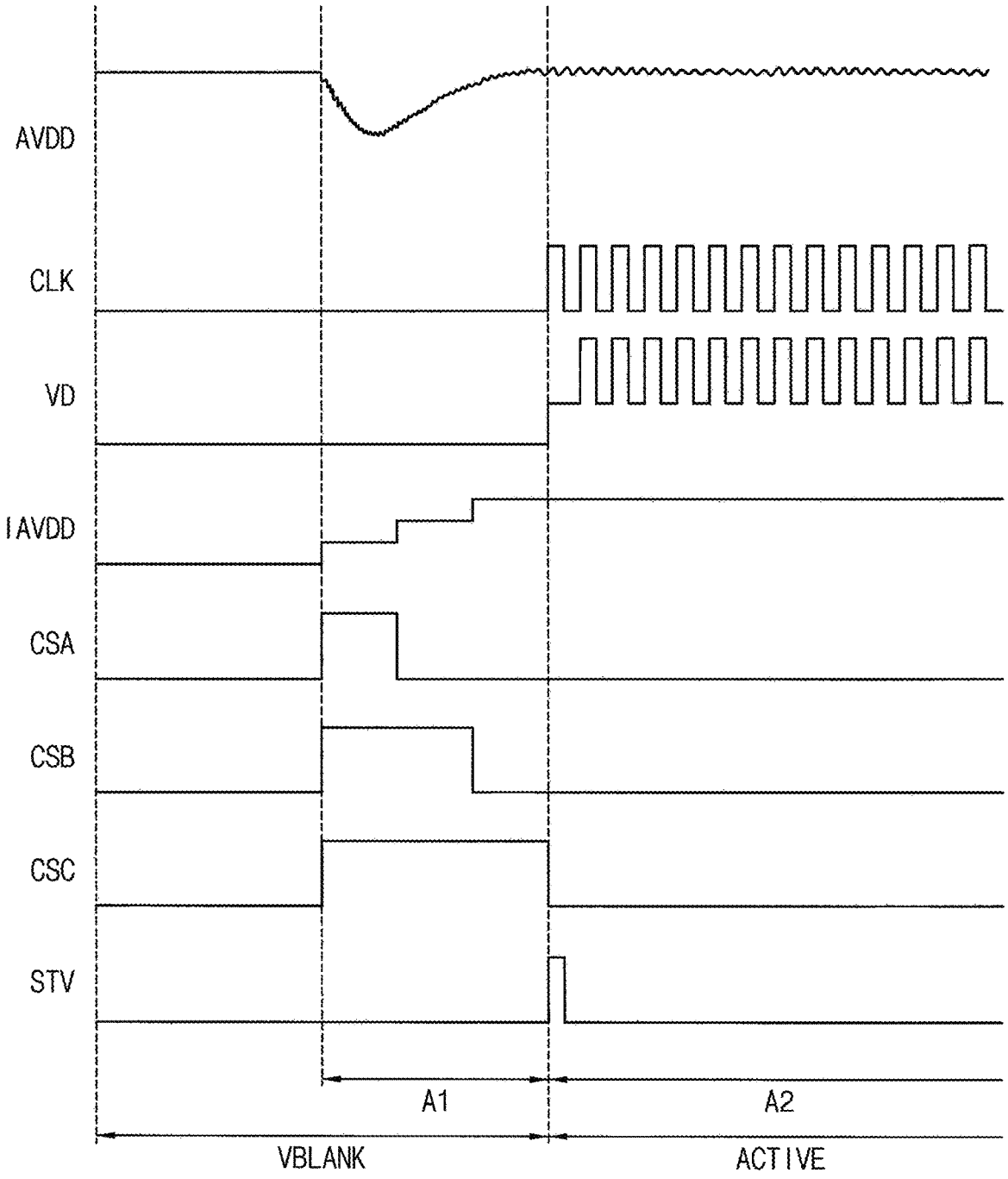
FIG. 10 is a timing diagram illustrating the display panel driving signals when the data power voltage is compensated by the timing compensator of FIG. 8.

FIG. 10 is a timing diagram illustrating the display panel driving signals when the data power voltage AVDD is compensated by the timing compensator 800A of FIG. 8;

Referring to FIG. 7A, the data power voltage AVDD may be maintained in a uniform level during a vertical blank period VBLANK. When the data driver 500 starts to output the data voltage VD to the display panel 100 in the active period ACTIVE, the data power voltage AVDD may be dramatically decreased due to a sudden increase of load IAVDD of the data driver 500 (period A1).

When an enough time passes from the start of the driving of the data driver 500, the data power voltage AVDD is returned to a stable level (period A2).

In a period where the level of the data power voltage AVDD is decreased, the level of the data voltage VD applied to the display panel 100 may be decreased in response to a target level so that a luminance of an image displayed on an upper portion of the display panel 100 corresponding to the start point of the active period ACTIVE may be decreased.

Referring to FIG. 10, the first to third compensating switches SA, SB and SC are turned on in response to the first to third compensating switch control signals CSA, CSB and CSC applied to the first to third compensating switches SA, SB and SC before the vertical start signal STV is applied. When the first to third compensating switches SA, SB and SC are turned on, the load IAVDD corresponding to combined resistance of the first to third compensating resistors RA, RB and RC is applied to the output node of the data power voltage AVDD from the vertical blank period VBLANK.

In an exemplary embodiment, the first to third compensating switches SA, SB and SC are turned on in the first duration so that a first load corresponding to parallel resistance of the first to third compensating resistors RA, RB and RC may be applied to output node of the data power voltage AVDD, for example. The second and third compensating switches SB and SC are turned on in the second duration so that a second load corresponding to parallel resistance of the second and third compensating resistors RB and RC may be applied to output node of the data power voltage AVDD. The second load may be greater than the first load. The third compensating switch SC is turned on in the third duration so that a third load corresponding to a resistance of the third compensating resistor RC may be applied to output node of the data power voltage AVDD. The third load may be greater than the second load. In the illustrated exemplary embodiment, the load IAVDD of the data power voltage AVDD may have a gradually increasing waveform by the first to third compensating parts. When the load IAVDD of the data power voltage AVDD gradually increases, a degree of drop of the data power voltage AVDD may be reduced so that the deterioration of the display panel may be stably prevented.

As a result, the data power voltage AVDD is dropped in the vertical blank period VBLANK (period A1 in FIG. 10) and the data voltage VD may have the target level from a first pulse in the start point of the active period ACTIVE (period A2 in FIG. 10).

According to the illustrated exemplary embodiment, the timing compensator 800A applies the load to the output node of the data power voltage AVDD in the vertical blank period VBLANK so that the waveform of the data power voltage AVDD may be controlled not to be dropped in the active period ACTIVE. Thus, the display quality of the display panel 100 may be prevented from deterioration due to the drop of the data power voltage AVDD. Therefore, the display quality of the display panel 100 may be enhanced. In addition, the display panel driving signal may be maintained in a uniform level during the vertical blank period VBLANK so that the power consumption of the display apparatus may be reduced.

Figure 11:
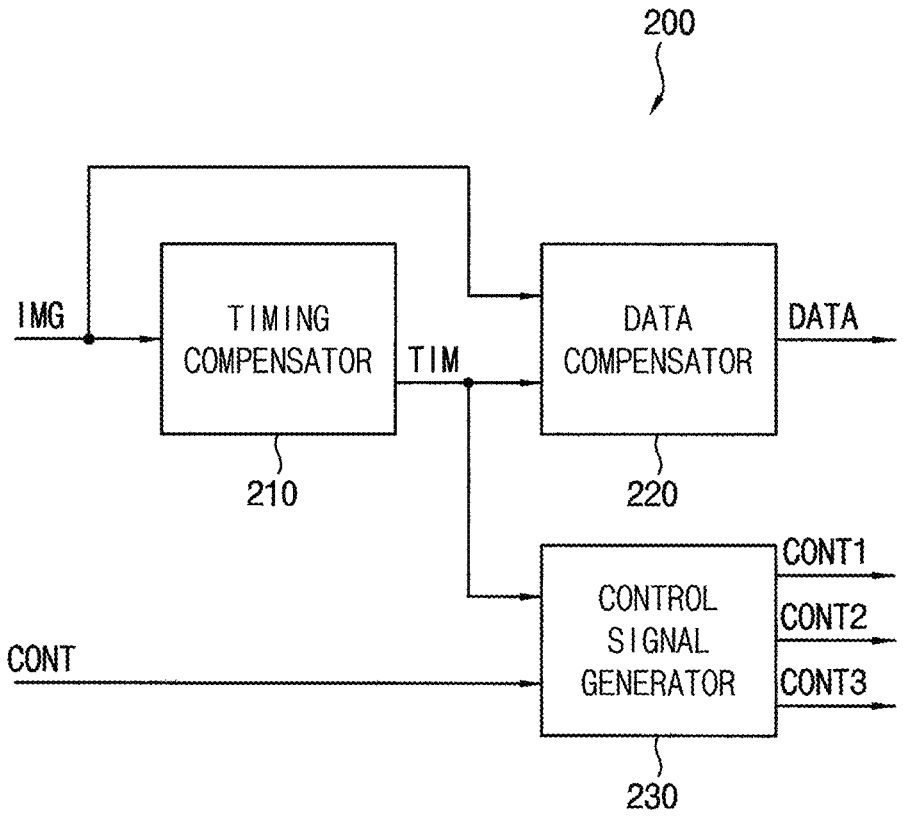
FIG. 11 is a circuit diagram illustrating an exemplary embodiment of a driving controller according to the invention.
Figure 12A:
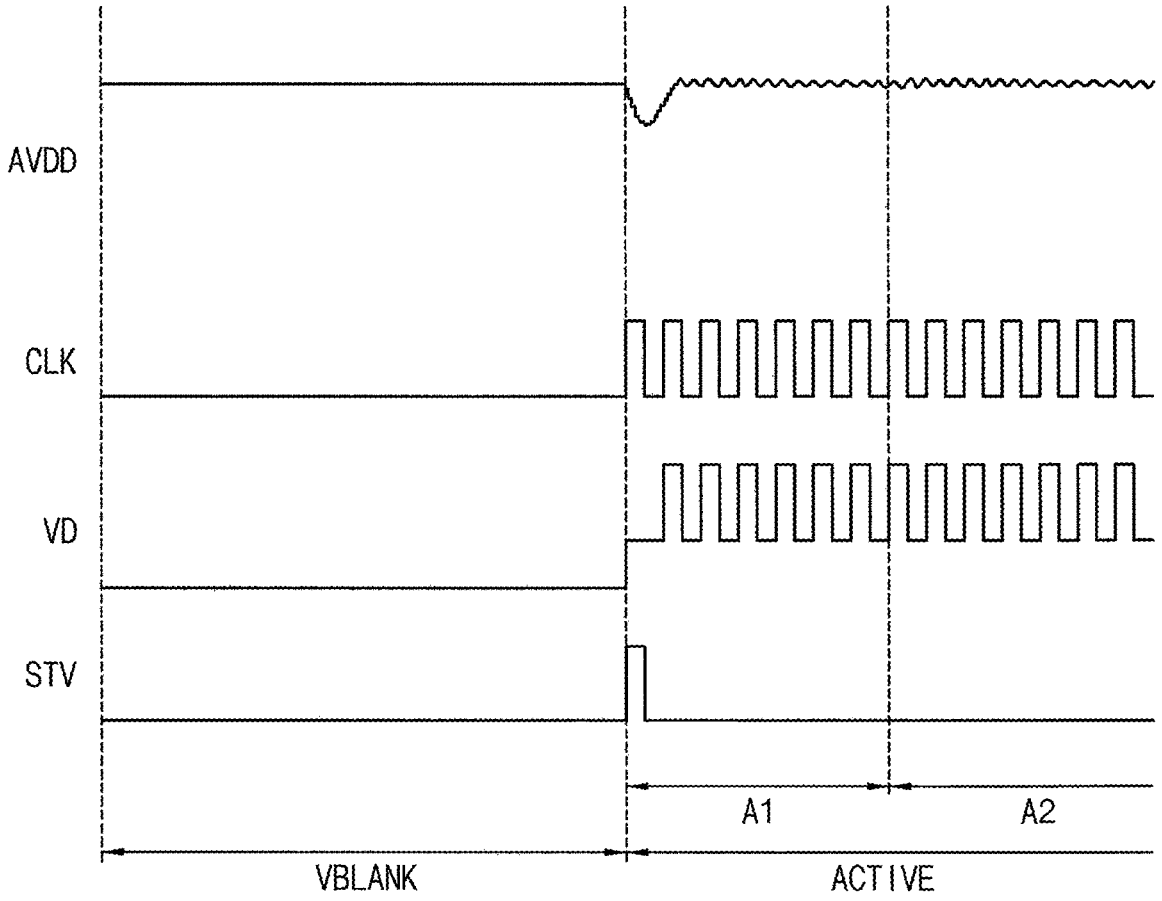
FIG. 12A is a timing diagram illustrating a display panel driving signals according to first input image data.
Figure 12B:
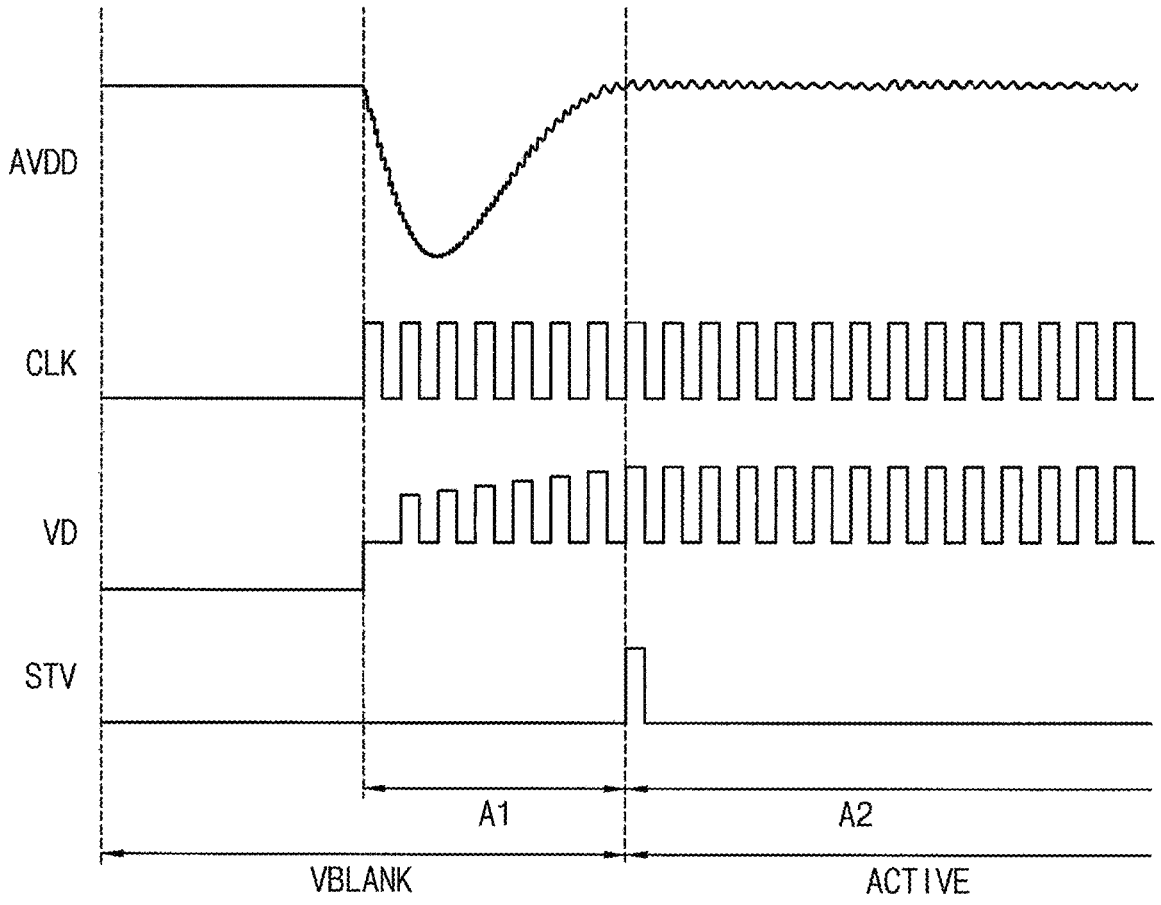
FIG. 12B is a timing diagram illustrating a display panel driving signals according to second input image data.

FIG. 11 is a circuit diagram illustrating a driving controller 200 according to an exemplary embodiment of the invention. FIG. 12A is a timing diagram illustrating display panel driving signals according to first input image data. FIG. 12B is a timing diagram illustrating display panel driving signals according to second input image data.

The power voltage generating circuit and the display apparatus according to the illustrated exemplary embodiment is substantially the same as the power voltage generating circuit and the display apparatus of the previous exemplary embodiment explained referring to FIGS. 1 to 4B except for the timing compensator. Thus, the same reference numerals will be used to refer to the same or like parts as those described in the previous exemplary embodiment of FIGS. 1 to 4B and any repetitive explanation concerning the above elements will be omitted.

Referring to FIGS. 1, 11, 12A and 12B, the display apparatus includes a display panel 100 and a display panel driver. The display panel driver includes a driving controller 200, a gate driver 300, a gamma reference voltage generator 400, a data driver 500 and a power voltage generator 600.

The display apparatus further includes the timing compensator 210 adjusting output timing of the data voltage VD of the data driver 500 based on the input image data IMG In an exemplary embodiment, the display apparatus may include the timing compensator 210 of the illustrated exemplary embodiment instead of the timing compensator 700 of the previous exemplary embodiment of FIG. 3, for example. In an alternative exemplary embodiment, the display apparatus may include both the timing compensator 700 of the previous exemplary embodiment and the timing compensator 210 of the illustrated exemplary embodiment.

In the illustrated exemplary embodiment, the timing compensator 210 may be disposed in the driving controller 200.

The driving controller 200 includes the timing compensator 210, a data compensator 220 and a control signal generator 230. The driving controller 200 is not physically divided into the blocks 210, 220 and 230 but logically divided into the blocks 210, 220 and 230 for convenience of explanation.

The load of the data driver 500 at the start point of the active period ACTIVE may be varied according to the input image data IMG applied to the driving controller 200. When the load of the data driver 500 at the start point of the active period ACTIVE is relatively large, the drop of the data power voltage AVDD may be large. In contrast, when the load of the data driver 500 at the start point of the active period ACTIVE is relatively small, the drop of the data power voltage AVDD may be small.

In an exemplary embodiment, when the input image data IMG represent a single color image, the data driver 500 may output the data voltage VD maintaining the same level so that the load of the data driver 500 may be small, for example. When the input image data IMG represent a horizontal stripe image, the data voltage VD may swing between a high level and a low level so that the load of the data driver 500 may be large. The load of the data driver 500 according to the input image data IMG may be varied according to a panel structure of the display panel 100 and a buffer structure of the data driver 500.

The timing compensator 210 analyzes the input image data IMG and outputs a timing signal TIM representing the driving timing of the data driver 500 to the data compensator 220 and the control signal generator 230.

When the drop of the data power voltage AVDD at the start point of the active period ACTIVE is small, the timing compensator 210 may advance the output timing of the data voltage VD of the data driver 500 by a small amount. When the drop of the data power voltage AVDD at the start point of the active period ACTIVE is large, the timing compensator 210 may advance the output timing of the data voltage VD of the data driver 500 by a large amount.

First input image data in FIG. 12A may cause a small drop of the data power voltage AVDD at the start point of the active period ACTIVE. In FIG. 12A, the drop of the data power voltage AVDD is very small at the start point of the active period ACTIVE so that the data voltage VD may have the target level from a first pulse in the start point of the active period ACTIVE. Thus, the timing compensator 210 does not advance the output timing of the data voltage VD of the data driver 500.

Second input image data in FIG. 12B may cause a large drop of the data power voltage AVDD at the start point of the active period ACTIVE. In FIG. 12B, the timing compensator 210 may adjust the output timing of the data voltage VD such that the start point of outputting the data voltage VD is in the vertical blank period VBLANK which is prior to the active period ACTIVE. As a result, the data power voltage AVDD is dropped in the vertical blank period VBLANK (period A1 in FIG. 12B) and the data voltage VD may have the target level from a first pulse in the start point of the active period ACTIVE (period A2 in FIG. 12B).

The data compensator 220 receives the input image data IMG from an external apparatus. The data compensator 220 compensates the input image data IMG to generate the data signal DATA. The data compensator 220 outputs the data signal DATA to the data driver 500. The data compensator 220 may output the data signal DATA to the data driver 500 in response to the timing signal TIM.

In an exemplary embodiment, the data compensator 220 may include a color characteristic compensating part (not shown) and a dynamic capacitance compensating part (not shown), for example.

The color characteristic compensating part receives the input image data IMG, and performs an adaptive color correction ("ACC"). The color characteristic compensating part may compensate the input image data RGB using a gamma curve. The dynamic capacitance compensating part performs a dynamic capacitance compensation ("DCC") to compensate current frame data using previous frame data and the current frame data.

The control signal generator 230 receives the input control signal CONT from the external apparatus. The control signal generator 230 receives the timing signal TIM from the timing compensator 210.

The control signal generator 230 generates the first control signal CONT1 based on the input control signal CONT and the timing signal TIM. The control signal generator 230 outputs the first control signal CONT1 to the gate driver 300. The control signal generator 230 generates the second control signal CONT2 based on the input control signal CONT and the timing signal TIM. The control signal generator 230 outputs the second control signal CONT2 to the data driver 500. The control signal generator 230 generates the third control signal CONT3 based on the input control signal CONT and the timing signal TIM. The control signal generator 230 outputs the third control signal CONT3 to the gamma reference voltage generator 400.

According to the illustrated exemplary embodiment, the timing compensator 210 adjusts the output timing of the data driver 500 according to the input image data IMG so that the waveform of the data power voltage AVDD may be controlled not to be dropped in the active period ACTIVE. Thus, the display quality of the display panel 100 may be prevented from deterioration due to the drop of the data power voltage AVDD. Therefore, the display quality of the display panel 100 may be enhanced. In addition, the display panel driving signal may be maintained in a uniform level during the vertical blank period VBLANK so that the power consumption of the display apparatus may be reduced.

According to the invention as explained above, the display quality of the display panel may be enhanced and the power consumption of the display apparatus may be reduced.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A display apparatus comprising:

a display panel which displays an image based on input image data;

a data driver which outputs a data voltage to the display panel;

a power voltage generator which outputs a data power voltage to the data driver;

a driving controller which controls a driving timing of the data driver; and a timing compensator which changes an output timing of the data voltage of the data driver when a feedback data power voltage is less than a reference data power voltage at a start point of an active period independent of a data signal from the data driver, wherein the timing compensator adjusts the output timing of the data voltage such that a start point of outputting the data voltage is in a vertical blank period which is prior to the active period, the vertical blank period and active period being in a same frame.

2. The display apparatus of claim 1, wherein the reference data power voltage is the data power voltage which is fed back after a first time from a rising edge of a vertical start signal.

3. The display apparatus of claim 1, wherein the timing compensator comprises:

an analog to digital converter which converts the feedback data power voltage and the reference data power voltage; and a data power voltage comparator which compares a converted feedback data power voltage and a converted reference data power voltage.

4. The display apparatus of claim 3, wherein the analog to digital converter and the data power voltage comparator are disposed in the power voltage generator.

5. The display apparatus of claim 3, wherein the analog to digital converter is disposed in the power voltage generator, and wherein the data power voltage comparator is disposed in the driving controller.

6. The display apparatus of claim 1, wherein the power voltage generator comprises:

a capacitor comprising a first electrode connected to an input node and a second electrode connected to a ground;

an inductor comprising a first end portion connected to the input node and a second end portion connected to a first node;

a diode comprising an anode electrode connected to the first node and a cathode electrode connected to an output node;

a switch comprising a control electrode connected to a switch controller, an input electrode connected to the first node and an output node connected to the ground;

a resistor comprising a first end portion connected to the output node and a second end portion connected to a feedback node;

an error amplifier comprising a first input electrode connected to the feedback node, a second input electrode to which a reference voltage is applied and an output electrode;

a comparator comprising a first input electrode connected to the output electrode of the error amplifier, a second input electrode to which a comparison voltage and an output electrode connected to the switch controller; and the switch controller which is connected to the comparator and controls the switch, wherein the timing compensator is connected to the feedback node.

7. The display apparatus of claim 1, further comprising a second timing compensator which applies a load to an output node of the data power voltage in a vertical blank period prior to the active period.

8. The display apparatus of claim 7, wherein the second timing compensator comprises a compensating resistor and a compensating switch connected in series.

9. The display apparatus of claim 7, wherein the second timing compensator comprises:

a first compensating part comprising a first compensating resistor and a first compensating switch connected in series; and a second compensating part comprising a second compensating resistor and a second compensating switch connected in series, the second compensating part being connected to the first compensating part in parallel.

10. The display apparatus of claim 9, wherein a turn-on period of the first compensating switch is different from a turn-on period of the second compensating switch.

11. The display apparatus of claim 7, wherein the power voltage generator comprises:

a capacitor comprising a first electrode connected to an input node and a second electrode connected to a ground;

an inductor comprising a first end portion connected to the input node and a second end portion connected to a first node;

a diode comprising an anode electrode connected to the first node and a cathode electrode connected to an output node;

a switch comprising a control electrode connected to a switch controller, an input electrode connected to the first node and an output node connected to the ground;

a resistor comprising a first end portion connected to the output node and a second end portion connected to a feedback node;

an error amplifier comprising a first input electrode connected to the feedback node, a second input electrode to which a reference voltage is applied and an output electrode;

a comparator comprising a first input electrode connected to the output electrode of the error amplifier, a second input electrode to which a comparison voltage and an output electrode connected to the switch controller; and the switch controller which is connected to the comparator and controls the switch, wherein the second timing compensator is connected to the feedback node.

12. The display apparatus of claim 1, further comprising a second timing compensator which adjusts the output timing of the data voltage of the data driver according to the input image data.

13. The display apparatus of claim 12, wherein the second timing compensator is disposed in the driving controller.

14. A power voltage generating circuit comprising:

a capacitor comprising a first electrode directly connected to an input node to which an input voltage is applied and a second electrode connected to a ground;

an inductor comprising a first end portion connected to the input node and a second end portion directly connected to a first node;

a diode comprising an anode electrode connected directly to the first node and a cathode electrode connected to an output node which outputs an output voltage;

a switch comprising a control electrode connected to a switch controller, an input electrode connected directly to the first node and an output node connected to the ground;

a resistor comprising a first end portion connected to the output node and a second end portion connected to a feedback node;

an error amplifier comprising a first input electrode connected to the feedback node, a second input electrode to which a reference voltage is applied and an output electrode;

a comparator comprising a first input electrode connected to the output electrode of the error amplifier, a second input electrode to which a comparison voltage and an output electrode connected to the switch controller;

the switch controller which is connected to the comparator and controls the switch; and a timing compensator connected to the feedback node to receive a feedback output voltage, the timing compensator outputs a timing compensating signal according to a level of the feedback output voltage.

15. The power voltage generating circuit of claim 14, wherein the timing compensator comprises a compensating resistor and a compensating switch connected in series.

16. The power voltage generating circuit of claim 14, wherein the timing compensator comprises:

a first compensating part comprising a first compensating resistor and a first compensating switch connected in series; and a second compensating part comprising a second compensating resistor and a second compensating switch connected in series, the second compensating part being connected to the first compensating part in parallel.

17. The power voltage generating circuit of claim 16, wherein a turn-on period of the first compensating switch is different from a turn-on period of the second compensating switch.

18. A power voltage generating circuit comprising:

a capacitor comprising a first electrode connected to an input node to which an input voltage is applied and a second electrode connected to a ground;

an inductor comprising a first end portion connected to the input node and a second end portion connected to a first node;

a diode comprising an anode electrode connected to the first node and a cathode electrode connected to an output node which outputs an output voltage;

a switch comprising a control electrode connected to a switch controller, an input electrode connected to the first node and an output node connected to the ground;

a resistor comprising a first end portion connected to the output node and a second end portion connected to a feedback node;

an error amplifier comprising a first input electrode connected to the feedback node, a second input electrode to which a reference voltage is applied and an output electrode;

a comparator comprising a first input electrode connected to the output electrode of the error amplifier, a second input electrode to which a comparison voltage and an output electrode connected to the switch controller;

the switch controller which is connected to the comparator and controls the switch; and a timing compensator connected to the feedback node to receive a feedback output voltage, the timing compensator output a timing compensating signal according to a level of the feedback output voltage, wherein the timing compensator comprises:

an analog to digital converter which converts the feedback output voltage and a reference data power voltage; and a data power voltage comparator which compares a converted feedback output voltage and a converted reference data power voltage.

* * * * *